United States Patent [19]

Nitz et al.

[11] Patent Number: 4,934,284

[45] Date of Patent: Jun. 19, 1990

[54] COAL DISTRIBUTION CONE FOR PULVERIZED COAL BURNERS

[76] Inventors: Mark G. Nitz, 8539 Edenton Road, Fulton, Md. 20759; Richard S. Taylor, Jr., 4387 Raliegh Ave., Apt. 102, Alexandria, Va. 22304

[21] Appl. No.: 315,980

[22] Filed: Feb. 27, 1989

[51] Int. Cl.[5] ..... F23D 1/00

[52] U.S. Cl. ..... 110/263; 110/282; 110/347

[58] Field of Search ..... 110/260, 261, 262, 263, 110/264, 265, 232, 347

[56] References Cited

U.S. PATENT DOCUMENTS

| | | | |
|---|---|---|---|
| 886,050 | 4/1908 | Fraser . | |
| 901,232 | 11/1908 | Eldred . | |
| 2,220,603 | 11/1940 | Hirtz et al. . | |
| 2,757,723 | 8/1956 | Schlitt . | |
| 3,302,596 | 2/1967 | Zinn . | |
| 3,529,917 | 9/1970 | Hindenlang . | |
| 3,934,522 | 1/1976 | Booker | 110/263 |
| 4,380,202 | 4/1983 | LaRue et al. | 110/263 |
| 4,604,052 | 8/1986 | Brown et al. | 110/264 X R |
| 4,611,543 | 9/1986 | Collette . | |
| 4,654,001 | 3/1987 | LaRue . | |
| 4,807,541 | 2/1989 | Masai et al. | 110/263 X R |

OTHER PUBLICATIONS

Joseph Singer, *Combustion: Fossil Power Systems* (1981), Chapter 13, pp. 13-1-13-15.

Bernhardt Skrotski, *Electric Generation-Steam Stations* (1956), Chapter 3, pp. 77-117.

Babcock & Wilcox, *Steam/ its generation and use* (1975), Chapter 6, pp. 6-1-6-22 and Chapter 9, pp. 9-1-9-16.

*Primary Examiner*—Edward G. Favors

*Attorney, Agent, or Firm*—Lowe, Price, Leblanc, Becker & Shur

[57] ABSTRACT

A pulverized fuel distribution cone for use in a pulverized fuel burner having a tubular burner pipe with flanged and furnace ends and an elbow connector having a flanged end for connection of the elbow to the flanged end of the burner pipe. The distribution cone includes an open base section and an open outlet end portion extending into the burner pipe. A planar flange extending outwardly from the base section of the cone is retained between the flanged ends of the elbow connector and pipe. The flow cone preferably is positioned in the pipe at a distance from the furnace end of the burner of at least four times a diameter of the pipe. An angle between the wall of the cone and its base in the range of from 75° to 85° results in a flow deflection of between 5 and 15 degrees, respectively. The length of the cone in the flow path preferably is in a range from four to fourteen inches.

16 Claims, 4 Drawing Sheets

COAL DISTRIBUTION CONE FOR PULVERIZED COAL BURNERS

TECHNICAL FIELD

This invention relates in general to fuel burning in energy conversion systems apparatus, and more particularly to a novel burner nozzle located in the throat of a burner for pulverized fuels.

BACKGROUND ART

Steam power generating facilities and steam heating plants convert the chemical energy of fossil fuels into useful thermal energy. The thermal energy released by combustion of the fuel is absorbed by water to produce steam that in turn is used to power a turbine-generator to produce electric power.

A majority of power plants burn pulverized coal as a readily available source of fossil fuel. FIG. 1 is a diagram of a typical direct-firing system for pulverized coal. A bunker 10 stores raw coal which is fed to a pulverizer 12 where the coal is ground into a fine powder having coal particles of less than 300 microns in diameter. The pulverized coal is transported to one or more burners 16 by heated air, known as "primary air" which comprises approximately 20% of the air required for combustion.

A single boiler 18 may be equipped with one or more pulverizers 12; each may serve one or more burners 16. Load control is accomplished by varying the rate of coal fed to the pulverizer(s). To accommodate large load reductions, burners and/or pulverizers are removed from service.

Coal burners 16 supply air and fuel to the furnace to maintain (1) stable combustion, (2) effective control of flame shape, and (3) thorough mixing of the fuel and air. Pulverized coal enters the furnace through a burner nozzle where the coal is mixed with additional, or "secondary" air, admitted by burner registers surrounding coal burners 16. Burner pipes and nozzles are sized so that primary air velocities are sufficiently high to maintain the coal entrained in the air flow, but sufficiently low to prevent excessive wear on the equipment by the high abrasive coal particles.

Two major types of coal burners are used in corresponding furnaces structures. In an opposed firing furnace, horizontal wall burners face the furnace from opposite walls. In a tangential firing structure, horizontal burners are tangent to a circle centered in the furnace.

Most opposed firing burners are cylindrical with a central nozzle through which coal is admitted to the furnace. Air register doors located around the periphery of the burner admit secondary air into the furnace. Coal and air are mixed and forced into the furnace for combustion. Turbulence required for good combustion is largely controlled by adjustments made to the burner itself. Flame shape can be adjusted somewhat by inserting/retracting a central impeller and by adjusting the opening of the air registers.

In a tangential firing furnace, the burners are rectangular in shape. Coal and primary air enter the furnace through fuel nozzles and secondary air enters through auxiliary nozzles located above and below the fuel nozzle. The coal/air mixture is forced into the furnace tangent to a circle about the center of the furnace. The mixture travels along a spiral trajectory toward the top of the furnace; the fireball is fed from burners located in the corners of the furnace. This spiral trajectory of the mixture provides the turbulence required for good combustion. In a tangential firing furnace, flame shape is not adjustable although air distribution can be controlled by adjusting the openings of the individual auxiliary air nozzle registers.

The transport and distribution of pulverized coal present several problems, in part because the coal, which is a solid, is transported by air (a compressible fluid). Since the densities of the two substances are different, the mixture tends not to remain homogeneous as it passes through bends in the supply piping system of the burner. Instead, the coal tends to flow toward the outside of the bend, resulting in an uneven distribution of coal over the cross-sectional area of the nozzle. Poor distribution results in an uneven wear of burner components and in reduced combustion efficiency due to poor mixing of the coal and air.

Coal distribution or flow cones have been used in burner nozzles and piping in an attempt to provide even coal mass/velocity distribution at the nozzle outlet. Uniform distribution eliminates localized areas of high velocity fluid movement which accelerates burner component wear rate. Good distribution of the pulverized coal and air mixture further improves combustion by providing an improved mix of the fuel and air in the ignition zone of the furnace. The distribution cones do this by forcing the coal to the center of the coal nozzle and allowing the coal to diverge from the center of the nozzle to completely fill the nozzle at its outlet.

Prior art distribution cones are sometimes included in opposed firing type burners by commercial manufacturers such as Babcock and Wilcox. Other manufacturers, such as Flame Refractories, Inc., provide flow cones for retrofit into existing burner equipment. In both original equipment and retrofited devices, the cone is supported by three legs radiating from, and attached to, the regulating or impeller rod and extending from the cone.

Because the prior art flow cones are attached to, and supported by, the central regulating rod, the cone tends to impede movement of the rod during reciprocal motion of the coal impeller. The cones frequently contact the inside surface of the nozzle due to warping of the cone, rod, or nozzle caused by high furnace temperatures, necessitating tedious alignment and trimming of each cone for proper operation.

Prior art designs further suffer from coal leaks between the outer edge of the cone and the inside of the coal nozzle resulting in accelerated wear of the nozzle. Leakage can result in reduction of nozzle life from a nominal 10–12 years to less than one year. Because planned outages are typically scheduled at 2 year intervals, additional maintenance time and expense are imposed.

Finally, prior art flow cones must be located near the center of the nozzle when the cones are in operation to facilitate insertion and retraction of the impeller and rod. Thus, the flow path of coal is insufficient in length downstream of the flow cone to enable the flow to fully expand or develop before coal reaches the impeller. The result is poor coal distribution; furthermore the center portion of the impeller tends to wear at a rapid rate.

A need therefore exists for a pulverized fuel distribution cone which does not impede impeller rod or impeller operation.

A need further exists for a pulverized fuel distribution cone which does not require extensive and repetitive alignment and trimming procedures for proper operation.

A need still further exists for a pulverized fuel flow cone which does not allow leakage to occur around the outer edges of the cone.

A need further exists for a pulverized fuel flow cone which is locatable an optimum distance from the impeller end of the nozzle.

A need still further exists for a pulverized fuel flow cone which is easily installed and removed.

Accordingly, an object of the invention is to provide a pulverized fuel flow cone which does not impede movement of a burner regulating/impeller rod operation of a burner impeller.

A further object of the invention is to provide a pulverized fuel cone which does not require alignment and trimming and is not susceptible to misalignment due to furnace heat and component warping.

Another object of the invention is to provide a pulverized fuel flow cone which is not subject to leakage around a peripheral portion thereof.

Still another object of the invention is to provide a pulverized fuel flow cone which is locatable an optimum distance upstream of the impeller end of a burner.

A further object of the invention is to provide a pulverized fuel flow cone which is easily installed and removed.

Still other objects and advantages of the present invention will become readily apparent to those skilled in this art from the following detailed description, wherein only the preferred embodiment of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DISCLOSURE OF THE INVENTION

In accordance with one aspect of the invention, a pulverized fuel distribution cone is provided for use in a pulverized fuel burner having a tubular burner pipe with flanged inlet and furnace ends, together with an elbow connector having a flanged end for connection thereof to the flanged end of the pipe. The distribution cone includes an open base section with an outwardly extending planar flange that is retained between the flanged ends of the elbow connector and burner pipe. An open outlet end portion of the cone extends into the pipe.

The length of the cone is determined so that the cone outlet portion is positioned in the burner pipe at a distance from the furnace end that is at least four times the diameter of the burner pipe. Nominally, the wall of the cone forms an angle of between 75° and 85° with respect to the base of the cone, and the axial length of the cone is from four to fourteen inches. The cone itself can be made of stainless steel and may include a ceramic coating to improve its abrasion resistance.

According to another aspect of the invention, a pulverized fuel burner includes a tubular burner pipe having a flanged end and a furnace input end. An elbow connector has a flanged end for connection thereof to the flanged end of the burner pipe. A fuel distribution cone has an open base section, and a planar flange extends outwardly therefrom and is retained between the flanged ends of the elbow connector and burner pipe. An open tapered end portion of the cone extends into the burner pipe.

According to still another aspect of the invention, a pulverized fuel distribution cone for use in the burner pipe of a pulverized fuel burner includes a flow directing member in the shape of a frustum of a right circular cone. The cone is open at both ends and is located coaxially in the burner pipe. A lower base of the flow directing member has an outer radius that is substantially equal to the inner radius of the burner pipe. A planar flange extends outwardly from the lower base of the flow directing member for retaining the flow directing member in position in the pipe.

BEST MODE FOR CARRYING OUT THE INVENTION

Figure 2:
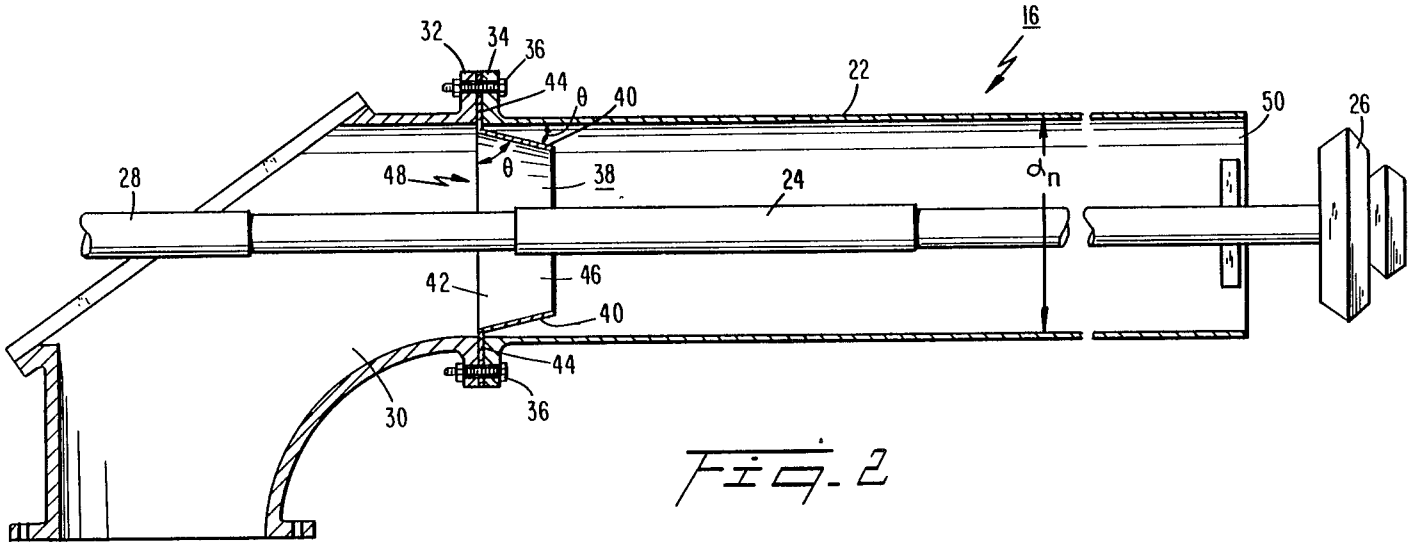
FIG. 2 is a cross-sectional side view of a circular burner including a flow cone installed according to one embodiment of invention.

Referring now to FIG. 2, burner nozzle 16 includes a burner pipe 22 with an impeller/regulating rod 24 extending axially therethrough and beyond end 50 of the nozzle to impeller 26. End 28 of the impeller/regulating rod 24 extends outside the coal path to permit adjustment of impeller 26. An elbow 30 is secured to pipe 22 of nozzle 16 at flanges 32 and 34 by through-bolts 36.

A flow cone 38 includes a flow directing member 40 having a conical shape and extending into burner tube 22. An open base section 42 of flow cone 38 is formed with an outwardly extending flange 44 retained between the flanged ends 32 and 34 of elbow connector 30 and burner pipe 22. Open outlet end portion 46 of cone 40 preferably extends into burner pipe 22 by a distance of from four to fourteen inches.

The angle $\theta$ of cone 40 shown in FIG. 2 is dependent on each installation and is further dependent upon the diameter and length of the burner nozzle 16, as well as the velocity of the coal at inlet 48 of nozzle 16. Although the cone should be as long as possible to have the greatest effect on coal distribution, length is limited because there must be a distance of a minimum of four nozzle diameters $d_n$ remaining from cone outlet 46 to impeller 26. This permits the coal flow to fully develop to eliminate local high velocities and resultant erosion damage. Because the position of the impeller in a cirulcar burner is adjustable outside of the burner pipe, the minimum spacing of four diameters may be conveniently measured from the burner furnace end 50.

Figure 1:
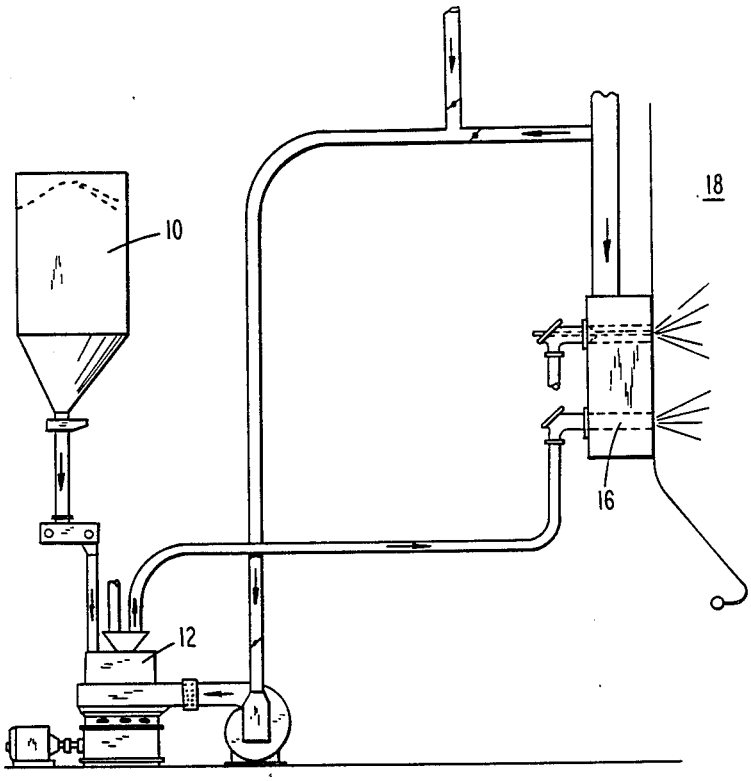
FIG. 1 is an overview of an opposed firing type pulverized fuel furnace with circular burners.
Figure 3:
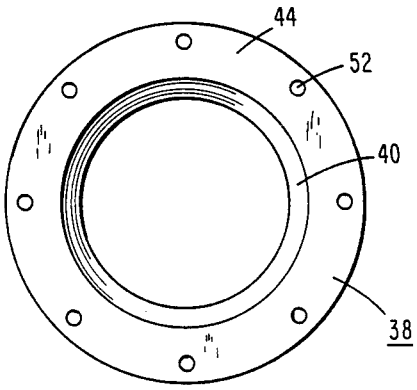
FIG. 3 is a front view of a flow cone according to the invention, with details of the flange assembly exposed.
Figure 4:
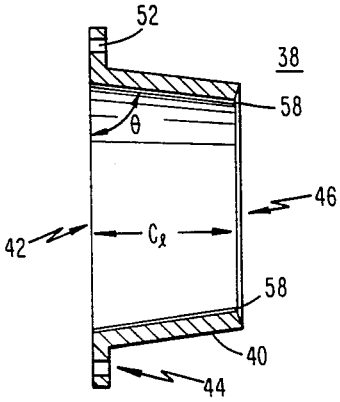
FIG. 4 is a cross-sectional side view of the flow cone of FIG. 3.

Flange 44 (FIG. 3) includes a plurality of through-holes 52 receiving bolts 36 for securing the cone 40 in position between flanges 32 and 34 of elbow 30 burner tube 22, respectively. The degree of taper of cone 40, defined by deflection angle $\phi$ ($\phi=90°-\theta$), is proportional to nozzle diameter $d_n$ and inversely proportional to the coal/air velocity and to the cone length. Deflection angle $\phi$ and angle $\theta$ are further limited since the flow cone has little effect at deflection angles of less than 5° ($\theta s>85°$) while deflection angles of greater than 15° ($\theta s<75°$) result in excessive wear on impeller rod 24. The length $C_1$ (FIG. 4) of cone 38 preferably is in a range of from four inches, with shorter lengths resulting in minimum effectiveness of the flow cone, to fourteen inches. For example, in a typical installation wherein the maximum flow velocity is 4200 feet-per-minute and a burner pipe inside diameter of 13 inches, a cone deflection angle of 11.3° ($\theta=78.7°$) and cone length of four inches are considered to be optimal. As shown in FIG. 4, the inner surface of cone 40 may be coated with a ceramic material 58 to improve resistance of the flow cone to erosion.

Figure 5:
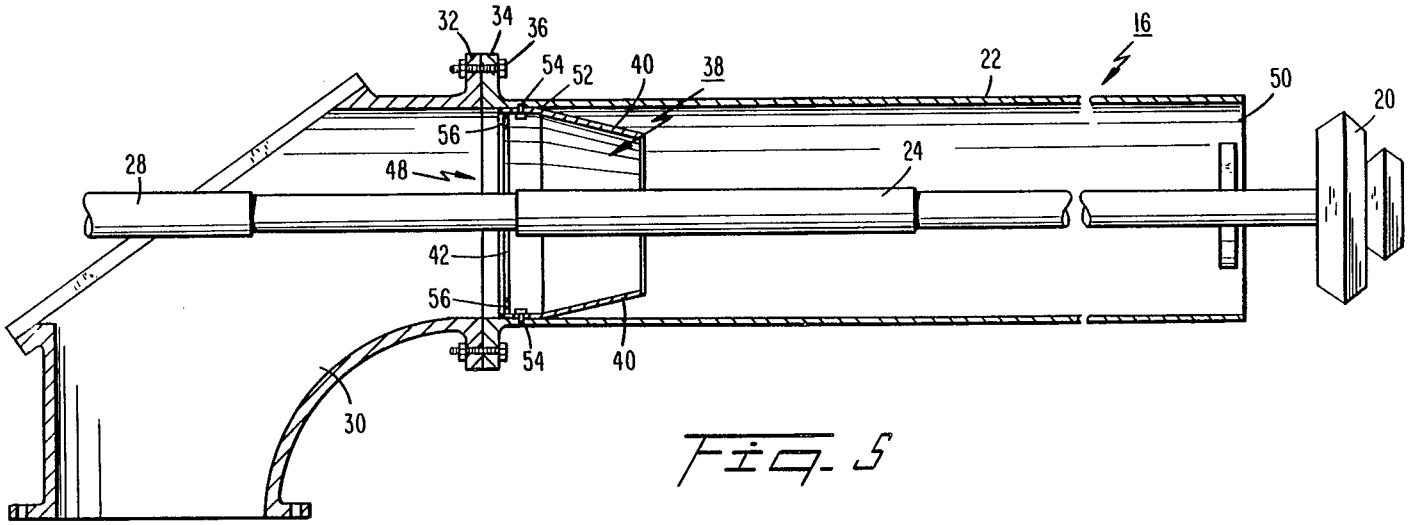
FIG. 5 is a cross-sectional side view of a circular burner including another embodiment of the invention wherein the flow cone includes a collar portion secured to the burner pipe using protected bolts.

With reference to FIG. 5, another embodiment of the invention is shown, wherein flow cone 38 includes a cylindrical collar portion 52 for attachment to the inner surface of burner pipe 22. In this embodiment, bolts 54 extend radially outward through collar portion 52 and burner pipe 22, securing the flow cone 38 in place. Radial shields 56 extend into the flow path to protect the bolts 54 from erosion.

Figure 6:
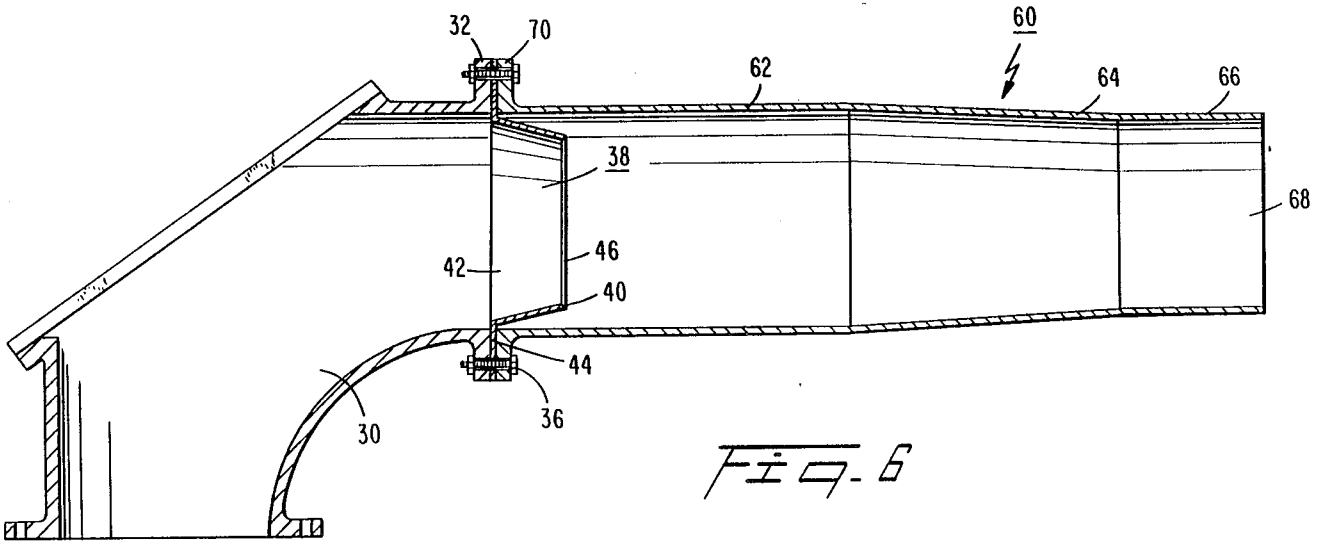
FIG. 6 is a cross-sectinal side view of a tangential burner including a flow cone installed according to one embodiment of invention.

The flow cone according to the invention is also applicable to tangential firing furnaces. Referring to FIG. 6, flow cone 38 is mounted in an inlet portion of tangential burner nozzle 60. Nozzle 60 includes a circular pipe portion 62 which connects through coupling portion 64 to a nozzle tip 66 having a rectangular cross section. Furnace end 68 of tangential firing burner 60 supplies pulverized coal and primary air to the furnace, while secondary air is admitted by registers surrounding nozzle tip 66. Flow cone 38 includes flange 44 retained between the flanged ends 32 and 70 of elbow connector 30 and tangential burner nozzle 60.

There has been described a novel coal distribution cone for use in a pulverized fuel burner having a conical section made of an alloy or stainless steel to withstand the high temperatures and erosive effects of coal particles encountered in the coal nozzle near a boiler furnace. The cone is welded to a flange for mounting the cone between the burner elbow and the burner nozzle. The flange can be made of a carbon steel as it operates at a lower temperature that of the cone and is not subjected to erosion from the coal particles. Alternatively, the device may be constructed integrally of a cast alloy or stainless steel piece including the flange and conical section. In a preferred embodiment the cone and flange are constructed of three-sixteenth inch stainless steel and is coated with a ceramic material to improve its resistance to erosion. By extending the cone inward from the inner surface of the burner pipe, leaks around the cone are avoided. Securing the cone at the inlet to the burner allows the cone to have a maximum effective length and avoids warpage of the cone due to high temperatures at the outlet of the nozzle to the impeller. Furthermore, use of a flange to attach the flow cone in position in the pipe simplifies installation, maintenance and replacement of the cone.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

We claim:

1. A pulverized fuel distribution cone for use in a pulverized fuel burner having a tubular burner pipe with flanged inlet and furnace ends and an elbow connector having a flanged end for connection thereof to the flanged end of the pipe, said distribution cone comprising:

an open base section;

a planar flange extending outwardly the open base section and being retained between the flanged ends of said elbow connector and pipe; and an open outlet end portion extending into said pipe.

2. The pulverized fuel distribution cone of claim 1, wherein the outlet portion of said cone is positioned in said pipe at a distance from the furnace end of said pipe of at least four times the diameter of said pipe.

3. The pulverized fuel distribution cone of claim 1, wherein the wall of said cone forms an angle of between 75° and 85° with respect to the base of said cone.

4. The pulverized fuel distribution cone of claim 1, wherein the axial length of said cone is from 4 to 14 inches.

5. The pulverized fuel distribution cone of claim 1, wherein said cone is made of stainless steel.

6. The pulverized fuel distribution cone of claim 1, wherein said cone includes a ceramic coating on the inside surface thereof.

7. The pulverized fuel distribution cone of claim 1, wherein said flange is made of a carbon steel.

8. A pulverized fuel burner, comprising:

a tubular burner pipe having a flanged end and an furnace end;

an elbow connector having a flanged end for connection thereof to the flanged end of said pipe; and a fuel distribution cone having an open base section, a planar flange extending outwardly therefrom and being retained between the flanged ends of said elbow connector and pipe, said cone further having an open tapered end portion extending into said pipe.

9. The pulverized fuel burner of claim 8, wherein the outlet portion of said cone is positioned in said pipe at a distance from the furnace end of said pipe of at least four times the diameter of said pipe.

10. The pulverized fuel burner of claim 8, wherein the wall of said cone forms an angle in the range of between 75° and 85° with respect to the base of said cone.

11. The pulverized fuel burner of claim 8, wherein the axial length of said cone is in the range of from 4 to 14 inches.

12. The pulverized fuel burner of claim 8, wherein said cone is made of stainless steel.

13. The pulverized fuel burner of claim 8, wherein said cone includes a ceramic coating on the inside surface thereof.

14. The pulverized fuel burner of claim 8, wherein said flange is made of a carbon steel.

15. The pulverized fuel burner of claim 8, including an axial impeller rod located within, and extending the length of, said tubular burner pipe.

16. A pulverized fuel burner, comprising:

a tubular burner pipe having a flanged end and an furnace end;

an elbow connector having a flanged end for connection thereof to the flanged end of said pipe;

an axial impeller control rod located within, and extending the length of, said tubular burner pipe;

an impeller attached to a furnace end of said control rod; and a fuel distribution cone having an open base section, a planar flange extending outwardly therefrom and being retained between the flanged ends of said elbow connector and pipe, said cone further having an open tapered end portion extending into said pipe, the outlet portion of said cone positioned in said pipe at a distance from the impeller of at least four times the diameter of said pipe.

* * * * *